US006427244B1

(12) United States Patent
Speier et al.

(10) Patent No.: US 6,427,244 B1
(45) Date of Patent: Aug. 6, 2002

(54) RESTRAINING DEVICE AND METHOD OF ITS USE TO ASSIST IN BREAST FEEDING

(76) Inventors: Michiko Speier, 3600 Potosi Ave., Studio City, CA (US) 91604; Joe Trojan, 115 1/2 Fleet St/, Marina Peninsula, CA (US) 90292

( * ) Notice: Subject to any disclaimer, the term of this patent is extended or adjusted under 35 U.S.C. 154(b) by 0 days.

(21) Appl. No.: 09/939,334

(22) Filed: Aug. 23, 2001

(51) Int. Cl.[7] ..... A41D 1/20
(52) U.S. Cl. ..... 2/104
(58) Field of Search ..... 2/104, 125, 126, 2/105–107, 74, 49.1, 48, 50–52, 920, 115, 270, 69

(56) References Cited

U.S. PATENT DOCUMENTS 4,446,572 A 5/1984 Lindquist
4,712,251 A 12/1987 Cobble
4,875,492 A 10/1989 Mitchell
4,878,879 A 11/1989 Kunstadter
5,893,171 A 4/1999 Ries
6,074,273 A 6/2000 Turner
6,081,925 A * 7/2000 Reiber ..... 2/125
6,175,961 B1 * 1/2001 Linden et al. ..... 2/125

* cited by examiner

*Primary Examiner*—Gloria M. Hale
*Assistant Examiner*—Tejash Patel
(74) *Attorney, Agent, or Firm*—Trojan Law Offices

(57) ABSTRACT

A device and method including the steps of placing a flexible restraint around the mother's neck, or secured to the inside of the mother's shirt, inserting a portion of the restraint under the shirt, pulling a portion of the restraint passed a bottom edge of the shirt and passed the exterior side of the shirt, and securing the restraint so that the shirt is raised above at least one breast to facilitate nursing.

4 Claims, 3 Drawing Sheets

RESTRAINING DEVICE AND METHOD OF ITS USE TO ASSIST IN BREAST FEEDING

BACKGROUND OF THE INVENTION

1. Field of the Invention

This invention relates to a method of assisting a mother in holding her clothing above one or both of her breasts to permit her child to nurse with reduced interference from her clothing.

2. Description of Related Art

There are numerous clothing related inventions to assist a mother in the task of breast feeding. Some of these inventions relate to providing privacy for the mother to permit her to breast feed in public places without suffering the apprehension of prying eyes. Examples of such devices are found in U.S. Pat. Nos. 5,893,171, 4,446,572 and 4,712,251. Other inventions relate to breast feeding bras such as found in U.S. Pat. Nos. 6,074,273, 4,878,879, and 4,875,492. But there are no inventions of which the inventor is aware that assist the mother in holding her clothing out of the way to permit the child unobstructed access to the mother's breasts. The present invention is intended to fill this gap in the art.

SUMMARY OF THE INVENTION

When a mother breast feeds her child, she must move her clothing out of the way to permit her child access to her breasts. Frequently, this is done by simply lifting her top above her breasts. The problem is that the top tends to fall back down thereby interfering with the nursing child's access to the source of nourishment. This can be annoying to both the baby and the mother. To combat the tendency of the top to slide down, the mother has to manually hold her top out of the way, or repeatedly push her top back up when it slides down, or take off her top entirely. Such solutions are inconvenient and somewhat annoying for the mother. The purpose of the present invention is to solve this problem by providing a device and method that can be used to quickly and conveniently hold the mother's top above her breasts during the nursing function. This frees both of the mother's hands to more securely hold the baby in the proper position for greater comfort and security for both the mother and child.

DESCRIPTION OF THE PREFERRED EMBODIMENTS

Figure 1:
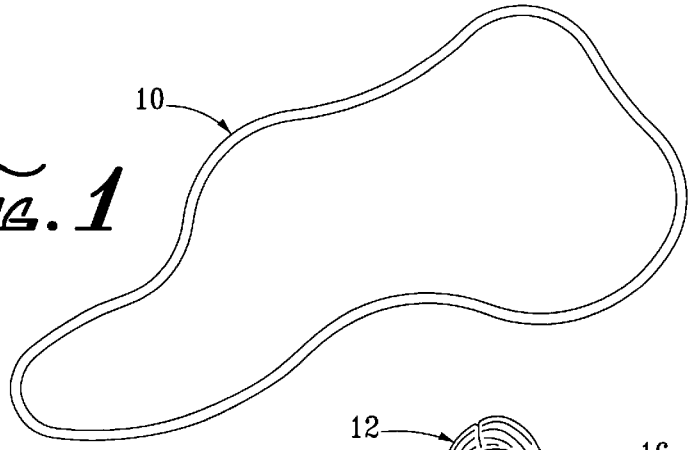
FIG. 1 is a perspective view of the preferred retaining necklace used with the method of the invention.
Figure 2:
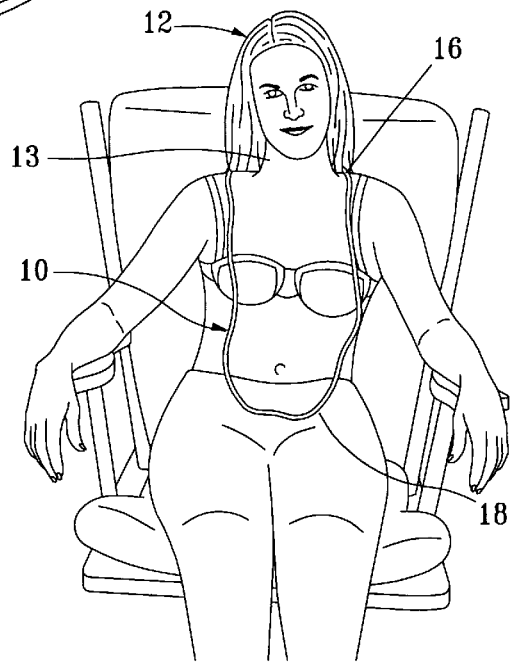
FIG. 2 is a frontal view depicting the first step in the method.
Figure 3:
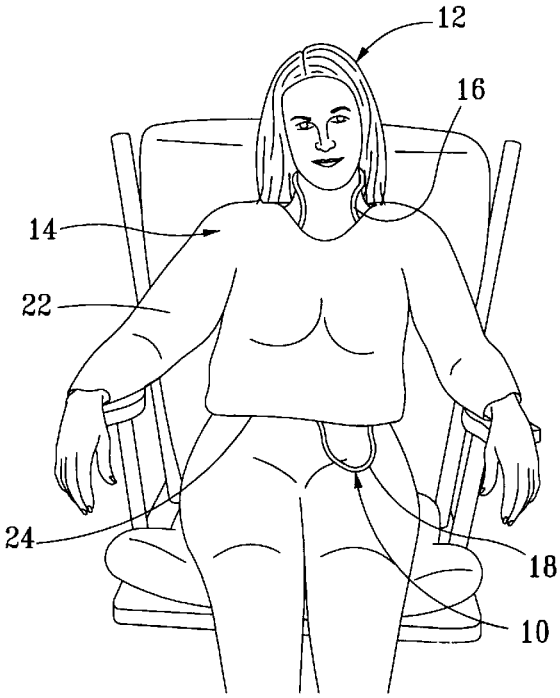
FIG. 3 is a frontal view depicting the second step in the method.
Figure 4:
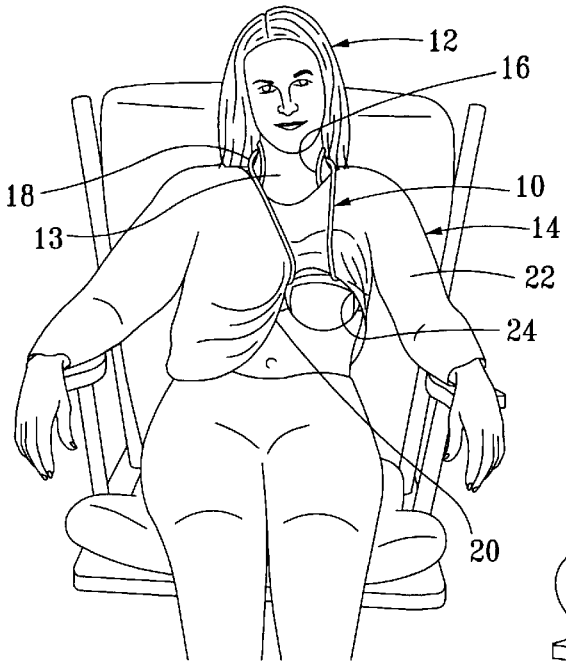
FIG. 4 is a frontal view depicting the third step in the method.
Figure 5:
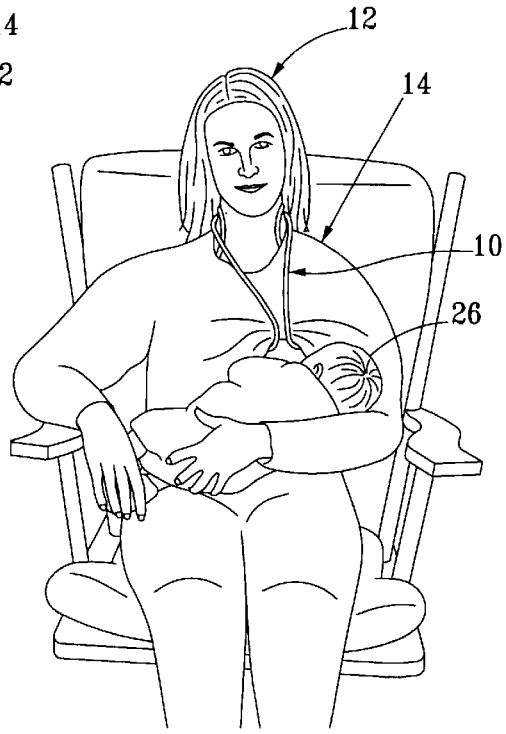
FIG. 5 is a frontal view depicting the fourth step in the method.
Figure 6:
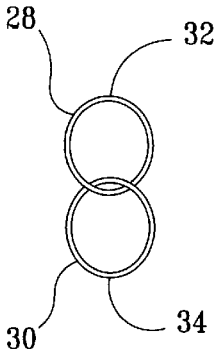
FIG. 6 is a frontal view of an alternative embodiment of the retaining necklace.
Figure 7:
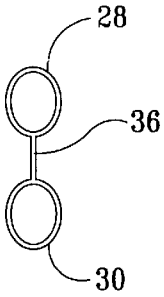
FIG. 7 is a frontal view of an alternative embodiment of the retaining necklace.

FIG. 1 depicts the preferred retaining necklace or loop 10 used in the method of the invention. The necklace can be a standard loop 10 as shown in FIG. 1, or it can have different shapes such as two or more closed loops joined together as shown in FIGS. 6 or 7. FIG. 2 is a frontal view of a mother 12 with a top portion 16 of the retaining necklace 10 placed around the mother's neck 13. FIG. 3 depicts the mother 12 wearing a shirt or top 14. The shirt 14 has an interior surface 20, an exterior surface 22, and a bottom edge 24. In FIG. 3, the retaining necklace 10 is shown being worn under the shirt 12 in contact with the interior surface 20 and a bottom portion 18 of the retaining necklace 10 is shown extending passed the bottom edge 24 of the top 14. FIG. 4 depicts the bottom portion 18 of the retaining necklace 10 having been placed around the mother's neck 13 so that the retaining necklace 10 passes the bottom edge 24 and exterior surface 22 of the top 14. When in this position, the top portion 16 and the bottom portion 18 of the necklace 10 are in close proximity to each other behind the mother's neck 13. FIG. 5 depicts the mother 12 nursing a child 26 while using the retaining necklace to hold the shirt 14 out of interference with the child 26

There are various ways that the retaining necklace can be designed while still falling within the scope of the invention. For example, in FIG. 6, a first loop and a second loop 30 are intertwined. First loop 28 having a top portion 32 is placed around the mother's neck 13 and second loop 30 having a bottom portion 34 is placed under the shirt 14. Just as with the preferred embodiment, the bottom portion 34 is pulled passed the bottom edge 24 of the shirt 14 to pass back along the exterior surface 22 of the shirt 14 so that the bottom portion 34 of the second loop 30 can be secured around the mother's neck 13. In the embodiment shown in FIG. 7, the first and second loops 28, 30 are connected together by extension 36. The loops are used in the same way as described for FIG. 6, except that the extension 36 contacts the bottom edge 24 of the top 14 to lift the top 14 of the mother during nursing. This and other such variations on the design of the retaining necklace do not change the basic method of use that constitutes the invention.

Figure 8:
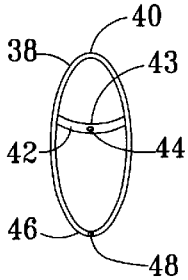
FIG. 8 is a frontal view of an alternative embodiment of the retaining necklace.

In FIG. 8, an embodiment is shown having a loop 38. The loop 38 has a top portion 40 that is positioned by the neck 13, and the loop 38 has a bottom portion 46. A strip 42 is secured to, or integrally formed with, the loop 38, leaving sufficient space between the strip 42 and the top portion 40 of the loop for the mother's neck 13 to comfortably fit. Secured to the strip 42, preferably at its midpoint 43, is a first attachment means 44 such as a button hole, velcro®-like material, snap, hook, string tie, or the like. There is a corresponding second attachment means 48 suitable for mating with said first attachment means 44. This embodiment can also function by eliminating the first attachment means 44 and making the second attachment means a simple string that ties around the strip 42.

Figure 11:
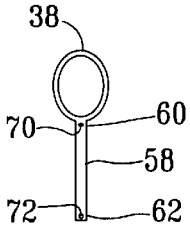
FIG. 11 is a frontal view of an alternative embodiment of the retaining device depicting a restraining strap secured to the loop.

In FIG. 11, a variation on the embodiment shown in FIG. 8 is disclosed. In FIG. 11, a restraining strip 58 is secured to loop 38. The loop fits about the neck 13. A restraining strip 58 is secured or integrally formed with said loop 38. The restraining strip 58 has a first end 60 and a second end 62. Located near the first end 60 is a first attachment point 70 having a button hole, velcro®-like material, snap, hook, clip, string tie, or the like. There is a corresponding attachment point 72 at said second end 62 suitable for mating with said first attachment point 70. During operation, the loop 38 is placed around the neck, and the restraining strip 58 is looped under the bottom edge of the shirt, and the first and second attachment points 70, 72 are attached together to permit nursing of the baby. The embodiments in FIGS. 8 and 11 are especially advantageous for mothers with long hair because it permits mothers to use the invention without the invention becoming entangled in their hair during when using it.

Figure 9:
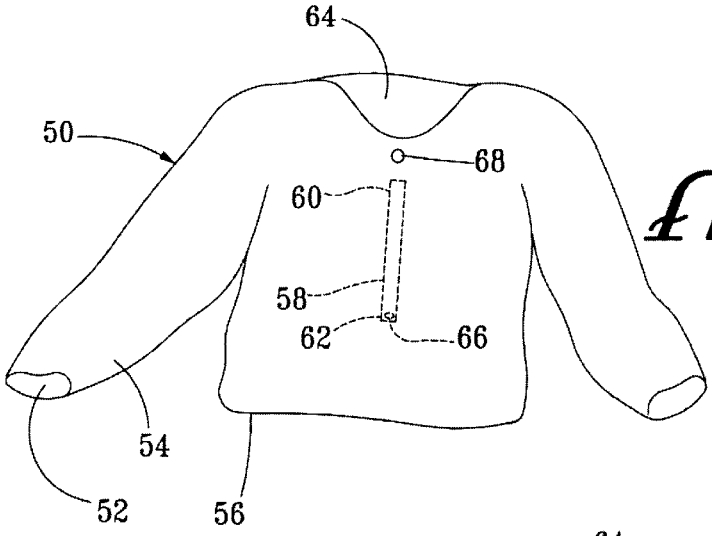
FIG. 9 is a frontal view of an alternative embodiment of the invention incorporated into a shirt.
Figure 10:
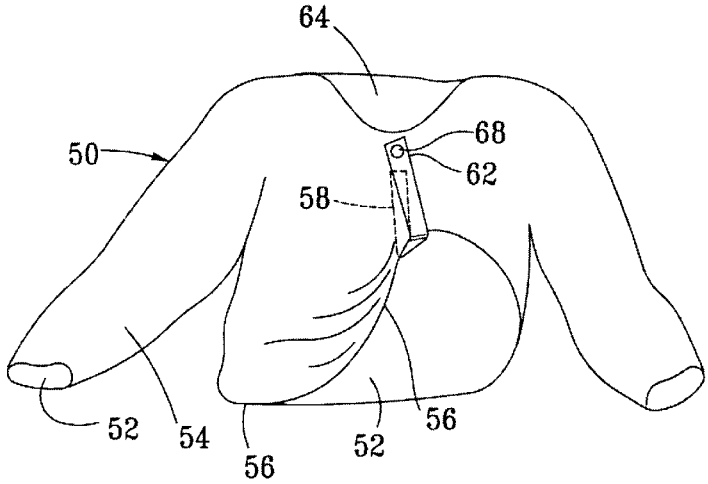
FIG. 10 is a frontal view of an alternative embodiment of the invention incorporated into a shirt shown in the restrained position.

In FIGS. 9 and 10, a shirt 50 is shown having an interior side 52, an exterior side 54, and a bottom edge 56. A restraining strip 58 is sewn, or otherwise secured, to the interior side 52 of the shirt 50 at a first end 60. The first end 60 is attached to the interior side 52 in proximity to a neck opening 64 in the shirt 50. The restraining strip also has a second end 62. Located near the second end 62 is a first securing means 66 such as a button hole, velcro®-like material, snap, clip, or the like. On the exterior surface 54 in proximity to the neck opening 64, there is a corresponding second securing means 68 suitable for mating with said first securing means 66. The restraining strip 58 can also be detachable from the shirt 50. During operation, the restraining strip 58 is looped under the bottom edge 56 of the shirt 50, and the first and second securing means 66, 68 are attached together to permit nursing of the baby.

The materials used for construction of the retaining necklace can be any material that has sufficient flexibility to permit the necklace to fit around the mother's neck and loop under the shirt to extend around the mother's neck a second time. Cotton or silk would be preferred for their softness, but any sufficiently flexible material would serve the purpose.

Figure 12:
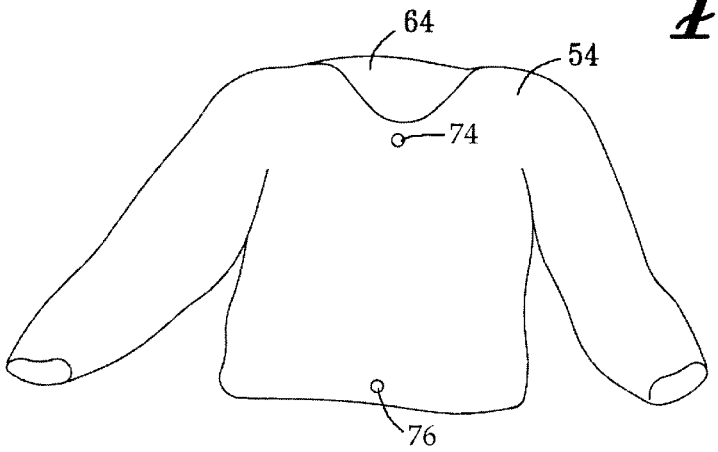
FIG. 12 is a frontal view of an alternative embodiment of the invention wherein two fastening means are secured together without the restraining strap.

FIG. 12 shows an alternative embodiment of the invention having a first fastening means 74 in proximity to the neck opening 64 on the exterior side 54 and a second fastening means 76 in proximity to the bottom edge 56. The second fastening means 76 can be on the interior side 52 or exterior side 54 of the shirt. The first and second fastening means can be any suitable fastening device that can be detachably secured together such as snaps, hook, string tie, velcro®, a button and button hole, and the like. When the first and second fastening means are detachably secured together, the shirt is effectively lifted out of the way to permit nursing.

While the invention as described in connection with its preferred embodiments, it will be understood that it is not intended to limit the invention to those embodiments. On the contrary, it is intended to cover all alternatives, modifications, and equivalents as may be included within the spirit and scope of the invention as defined by the appended claims.

We claim:

1. A method of assisting a mother to lift a top worn by the mother to permit a child to breast feed, said top having an interior side, an exterior side, and a bottom edge, comprising the steps of:

placing a flexible material forming a closed loop around the mother's neck, a first portion of said loop positioned behind said neck defining a top portion of said loop;

inserting said loop under the mother's top between the mother's body and said interior side of said top, a second portion of said loop farthest from said top portion defining a bottom portion of said loop;

raising said top of said mother to expose at least one breast;

lifting said bottom portion of said loop passed said bottom edge of said top and passed said exterior side of said top; and, looping said bottom portion of said loop over the mother's neck such that said top portion and said bottom portion are in close proximity to each other behind the mother's neck whereby said top is secured above the breast to permit the child to nurse without the top falling in the nursing activity.

2. A method of assisting a mother to lift a shirt worn by the mother to permit a child to breast feed, said shirt having an interior side, an exterior side, and a bottom edge, the mother having a neck, comprising the steps of:

placing a flexible restraint having a top portion and a bottom portion in a position so that said top portion is supported by said neck;

inserting said restraint under said shirt so that said restraint is positioned on said interior side of said shirt;

lifting said bottom portion of said restraint to pass by said bottom edge of said shirt and to pass by said exterior side of said shirt; and, securing said bottom portion of said restraint about said neck to prevent said shirt from falling down during nursing.

3. The method of claim 2 wherein said flexible restraint is formed of more than one loop.

4. A method of assisting a mother to lift a shirt worn by the mother to permit a child to breast feed, said shirt having an interior side, an exterior side, and a bottom edge, the mother having a neck, comprising the steps of:

placing a flexible restraint around the mother's neck;

inserting a portion of said restraint under said shirt so that said restraint is positioned on said interior side of said shirt;

pulling the portion of said restraint passed said bottom edge of said shirt and passed a portion of said exterior side of said shirt; and, securing said portion of said restraint on said exterior side of said shirt so that said shirt is raised above at least one breast to facilitate nursing.

* * * * *